United States Patent [19]

Dudrey et al.

[11] 4,350,282

[45] Sep. 21, 1982

[54] SELF-PURGING CENTRIFUGE

[75] Inventors: Denis J. Dudrey, Bloomington; John T. Herman, Mahtomedi, both of Minn.

[73] Assignee: Donaldson Company, Inc., Minneapolis, Minn.

[21] Appl. No.: 219,502

[22] Filed: Dec. 23, 1980

[51] Int. Cl.[3] ..... B04B 1/00

[52] U.S. Cl. ..... 233/7; 233/28

[58] Field of Search ..... 233/7, 8, 27, 47 R, 233/1 D, 14 R, 14 A, 19 R, 21, 22, 28, 46

[56] References Cited

U.S. PATENT DOCUMENTS

| | | | |
|---|---|---|---|
| B 422,467 | 1/1975 | Niemeyer | 233/19 A |
| 2,646,921 | 7/1953 | Adams | 233/8 |
| 3,443,748 | 5/1969 | Hooper | 233/8 |
| 3,701,469 | 10/1972 | Nilsson | 233/20 A |
| 3,741,466 | 6/1973 | Weiland | 233/38 |
| 3,741,467 | 6/1973 | Kjellgren | 233/41 |
| 3,750,940 | 8/1973 | Nilsson | 233/19 A |
| 3,752,389 | 8/1973 | Nilsson | 233/20 R |
| 3,777,972 | 12/1973 | Kjellgren | 233/20 A |
| 3,861,584 | 1/1975 | Dudrey | 233/7 |

*Primary Examiner*—Robert W. Jenkins

*Attorney, Agent, or Firm*—Merchant, Gould, Smith, Edell, Welter & Schmidt

[57] ABSTRACT

A self-purging centrifuge (10) for liquid/liquid/solid separation is the invention. It is useful in industries such as metal working where separation of a lighter liquid from a heavier liquid is achieved simultaneously with the separation of suspended solid particles, without requiring the use of a pre-filter.

The centrifuge (10) includes a rotatable drum (11), a driven rotor disc-assembly (22, 24, 25) mounted within the drum (11), extension means (50) for guiding the separated heavier liquid, apart from the separated lighter liquid, from the drum (11), separate liquid collection chambers (48, 53), and purge rods (65) for assisting in the removal of collected solids from the drum side wall (12).

Rotation of the drum (11) causes solid particles to collect on the drum side wall (12). Heavier liquid is separated from and flows upwardly apart from the lighter liquid. Lighter liquid moves inwardly, travelling upwardly through the individual discs in the disc assembly (22, 24, 25). Purging of the collected particles from the drum (11) is accomplished through an eroding, washing action created by the purge rods (65).

22 Claims, 4 Drawing Figures

SELF-PURGING CENTRIFUGE

TECHNICAL FIELD

This invention pertains to self-purging centrifuges and in particular to a centrifuge wherein there is simultaneous separation of solid particles, light liquid and heavier liquid from a fluid mixture with a subsequent purging of the separated solids from the centrifuge by creation of a washing or eroding action.

BACKGROUND OF THE INVENTION

The present invention is a rotor assembly of truncated cone discs designed for compatible use with a solids discharging means taught in U.S. Pat. No. 3,861,584, to Dudrey, for a "Self-Purging Centrifuge". The centrifuge in that patent is directed to the separation of a liquid from the solids suspended within the liquid. An effective purging process is taught in the patent whereby relatively small forces are used to wash the accumulated particles from the centrifuge drum wall. The particles become resuspended in the fluid and are then purged from the centrifuge system. Although proving to be highly effective for liquid/solid separations, the self-purging centrifuge of U.S. Pat. No. 3,861,584 cannot be operated as disclosed in the patent for liquid/liquid/solid separation.

There is a need in certain industries, e.g., metal working, for a centrifuge capable of separating a lighter liquid from a heavier liquid while simultaneously separating the suspended solid particles from both liquids, without necessitating the use of a pre-filter. Pre-filters are used in prior art centrifuges to remove larger size solid particles from a fluid prior to the application of centrifugal forces to the fluid. In addition to the use of pre-filters the centrifuges presently being used in the metal working industry normally operate at relatively high speeds of 6,000 to 20,000 rpm and as a result are subject to vibrational and unbalancing problems. Further, the prior art certrifuges have complicated "clamshell opening" constructions and sensoring means for the disposal of accumulated solid particles from the centrifuge's interior. The self-purging method of the centrifuge in U.S. Pat. No. 3,861,584 allows a simpler design while maintaining high effectiveness in the removal of accumulated solids. The present invention, using the purging technique taught in U.S. Pat. No. 3,861,584, provides a self-purging centrifuge which effectively allows the simultaneous separation of a light liquid, a heavier liquid and suspended solids from the fluid introduced into the centrifuge. The simple design, the absence of a pre-filter, and reduced operational speeds without accompanying vibrational and imbalancing problems, all combine with the structure of the present invention to provide industry with a self-purging centrifuge meeting its heretofore unanswered need for an economical yet effective liquid/liquid/solid centrifuge.

SUMMARY OF THE INVENTION

The invention is a self-purging centrifuge including a drum and a rotor assembly. The drum has a side wall and a top wall member and is mounted for rotation about a generally vertical axis. The rotor assembly is coaxially mounted within the drum for independent rotation. The rotor assembly includes a number of truncated cone discs nested together. The discs are spaced apart from each other by the use of radial spacers positioned between adjacent discs. Each disc, other than the bottommost disc, has at least one aperture, and usually as many as six, for the flow of separated light liquid therethrough. The disc apertures are aligned with respect to each other to form a passageway for the light liquid as it flows through the stacked discs. The outer peripheral edges of the rotor assembly are spaced a substantial distance from the drum side wall.

Contaminated fluid which is to be centrifuged is introduced into the drum to a location beneath the bottom of the rotor assembly. The contaminated fluid includes a light liquid, a heavier liquid and solid particles, each to be separated from the other. A driving means rotates the rotor assembly at a predetermined rate. From the bottom of the rotor assembly the contaminated fluid is flung outwardly by rotating paddles and fins toward the side wall of the drum. The contaminated fluid is propelled into a rotation movement directly toward the side wall of the drum, which then causes the drum to rotate. As contaminated fluid continues to be introduced into the rotor assembly and directed toward the side wall of the drum, an annular wall of fluid is built up along the side wall of the drum. Centrifugal forces cause the solid particles to accumulate along the side wall of the drum. The inner portion of the wall of fluid is clarified as a result of the particles being forced outwardly. The lighter liquid is "skimmed" from the heavier liquid within the disc assembly as the inner wall of fluid moves upward. The separated light liquid overflows the rotor assembly into drum top wall member openings as the heavier liquid flowing around the rotor assembly spills over into other drum top wall openings. Both the light liquid and the heavier liquid openings are spaced from the side wall of the drum with the peripheral edge of the rotor assembly extending beyond the openings.

The clarified light liquid is collected in an upper, annular collection chamber in the housing surrounding the drum and the rotor assembly. The clarified heavier liquid is collected in a separate lower collection chamber. The inner circular arrangement of light liquid openings in the drum top wall member and the outer circular arrangement of heavier liquid openings are protected from contaminated fluid and solids carryover during the purge cycle by the combination of an annular baffle member extending downwardly intermediate the two rings of openings, and an annular extension means mounted between the heavier liquid openings and the drum side wall. The extension means in addition to preventing carryover into the collection chambers also causes an improvement in the separation of the light liquid from the heavier liquid.

An annular baffle extends inwardly from the bottom of the side wall of the drum. The inner edge of the baffle is spaced from the drum side wall a greater distance than the outermost area of the liquid openings in the drum top wall so that the light and heavier liquids escape out of their respective openings rather than over the edge of the baffle during the separation process. Particles are collected in the area of the drum side wall between the top wall of the drum and the baffle on the bottom of the side wall of the drum. Braking means abruptly slow or stop the rotation of the drum to initiate a purge cycle. In the purge cycle, the rotating fluid wall is disrupted and the accumulated particles are resuspended in the fluid. The purge cycle is ended as the fluid with the resuspended particles drains over the baffle and out of the lower portion of the drum.

Because there is substantial clearance between the peripheral edges of the disc assembly and the side wall of the drum a washing or eroding action can be set up in the wall of fluid established in the drum. A pair of purge rods are mounted in opposed relation near the drum side wall. When the drum is braked, the contaminated fluid impacts the purge rods. A flat surface on a portion of the rods causes a flow diversion of the contaminated fluid for better penetration of the accumulated layer of solids. The subsequent washing action of the penetrating fluid causes the accumulated particles to be resuspended in the fluid. Circulatory flow patterns are set up by the revolving rotor assembly and those patterns promote the drainage of the fluid and the resuspended particles from the drum area.

According to one aspect of the present invention a self-purging centrifuge separating the liquids and solid particles of a contaminated fluid is provided in a simpler, more economical design requiring fewer of the high precision parts used in the prior art.

Another aspect of the present invention discloses a centrifuge which is highly tolerant of larger sized solid particles in relatively large quantities. This is due in part to the centrifuge's effective solids purging method which does not require the use of any prior art pre-filter within the centrifuge itself.

A further aspect of the present invention provides for operation of the centrifuge elements at relatively slow rotational speeds, thus avoiding the unbalancing and vibrational problems common in higher speed prior art centrifuges. Reduced rotational speeds allow larger disc diameters and thus longer residence times within the centrifuge.

Yet another aspect of the invention is its application in separation processes requiring recirculation of the contaminated fluid in order to achieve the desired degree of fluid component separation.

DESCRIPTION OF THE PREFERRED EMBODIMENT

Figure 1:
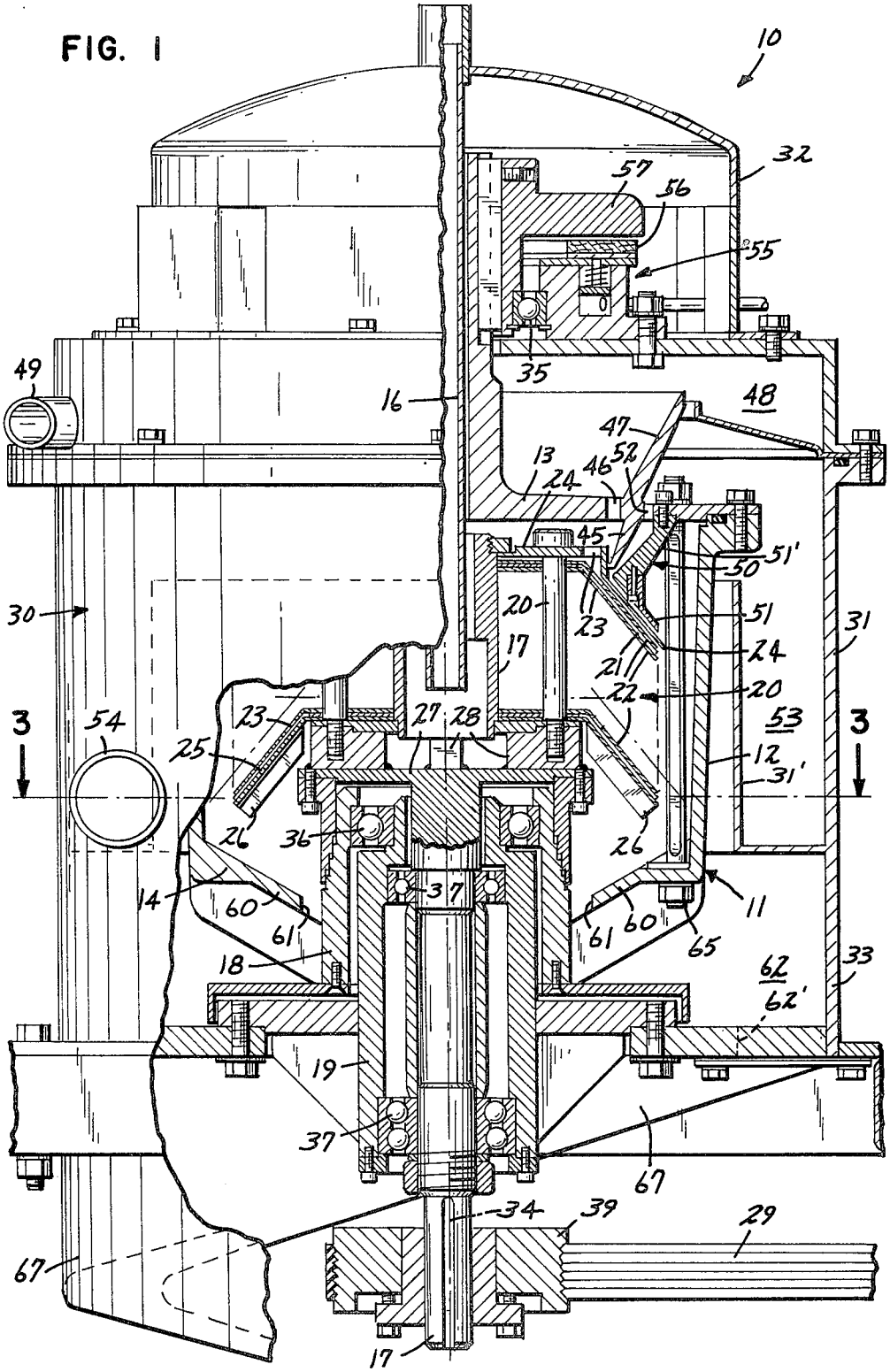
FIG. 1 is an elevational view of the present invention with portions broken away and shown in cross-section.
Figure 3:
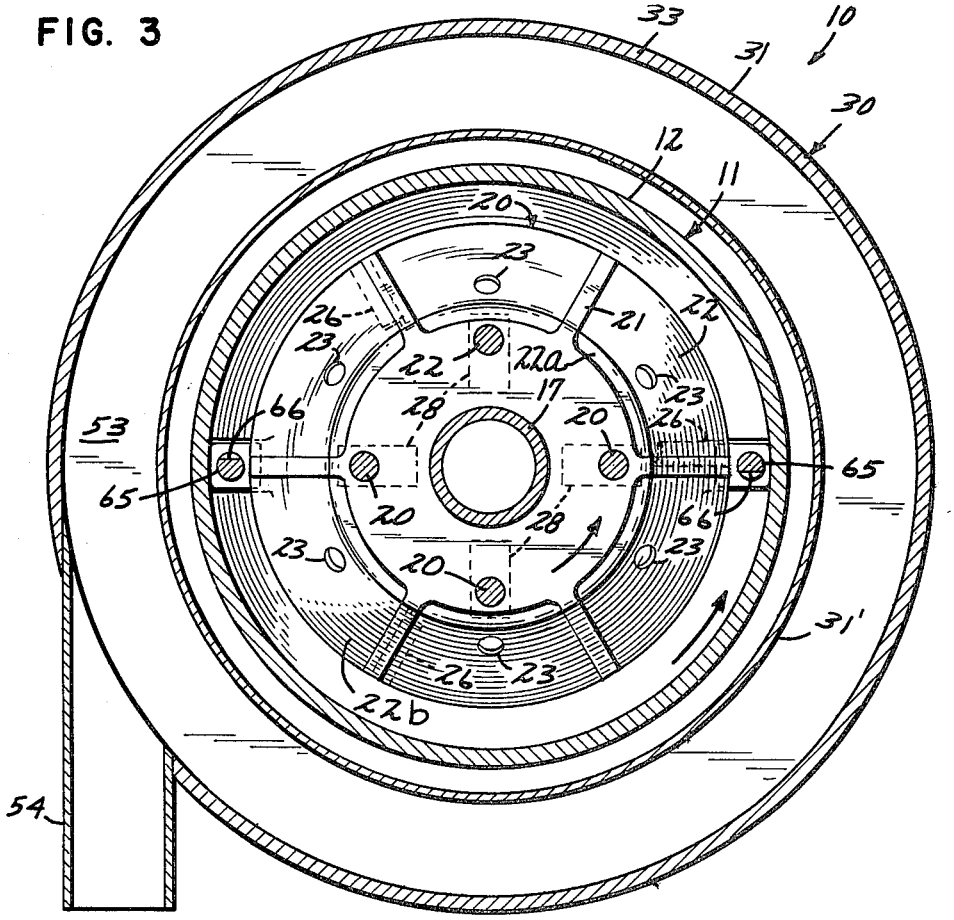
FIG. 3 is a cross-sectional view of the present invention as seen along lines 3—3 in FIG. 1.

Referring to FIG. 1, the centrifuge 10 has a drum 11 including a cylindrical side wall 12, a top wall member 13, and a frustoconical bottom member 14. The periphery of the bottom member 14 is attached to the bottom edge of the side wall 12 and the center extends into the drum 11. The rotor assembly includes a portion of the stationary inlet manifold 16, a shaft 17, a disc assembly mounted to the shaft 17, and radial spacers 21 secured within the disc assembly. The inlet manifold 16 is fixed to a portion of the housing cover 32, and extends downwardly from the housing cover 32 through the drum top wall member 13 and into the rotor disc assembly. In the embodiment shown in FIGS. 1 and 4, the disc assembly is a nested arrangement of spaced apart truncated cone discs 22, including a topmost and bottommost disc 24, 25, respectively. The shape of each disc 22, 24, 25 is basically a central flat circular portion *22a*, *24a*, *25a* from which extends downwardly a sloping annular peripheral portion *22b*, *24b*, *25b*. The sloping portion is the frusto-conical surface of the disc and in the preferred embodiment is sloped at a 50° angle from the plane of the flat surface portion *22a*, *24a*, *25a*. The radial spacers 17 maintain the spaced apart relationship between adjacent discs. As can be seen in FIG. 3, each spacer is a finger plate secured between adjacent discs. Each of the discs 22, not including the topmost and the bottommost discs 24, 25, has a circular arrangement of holes or apertures 23 along its conical surface. The topmost disc 24 has its openings 23 formed in the horizontal upper portion thereof generally in vertical alignment with openings 23 of discs 22. The circular patterns of disc apertures 23, as can best be seen in FIG. 3, are aligned within the assembly to allow a light liquid to flow upward as the disc assembly rotates. Flow holes in the disc portions located near the interface surface of the heavier liquid and the light liquid can also be provided, but are not shown in the preferred embodiment. In addition, each disc other than the top disc can include apertures for the passage of incoming contaminated fluid into the stacked disc assembly where separation of the liquids is enhanced because of the extended surface area provided by the plurality of discs. The bottommost disc 25 has attached along the underside of its conical portion a set of three fins 26 extending generally downward from the disc surface in the flow path of the incoming contaminated fluid. The fins 26 shown in broken lines in FIG. 3 are spaced apart at substantially equal intervals along the disc surface. A set of paddles 28, also shown in broken lines in FIG. 3, is mounted to a rotor shaft head 27 positioned below the truncated portion of the bottommost disc 25 of the rotor assembly. The rotor shaft head 27 is mounted in the drum 11 for coaxial rotation with the rotor assembly. Each paddle 28 is of rectangular shape and extends upward towards the bottommost disc 25 and radially outward from the rotor shaft 17. See FIG. 4. The paddles 28 are mounted at substantially equal intervals with respect to each other about the rotor shaft head 27.

Figure 2:
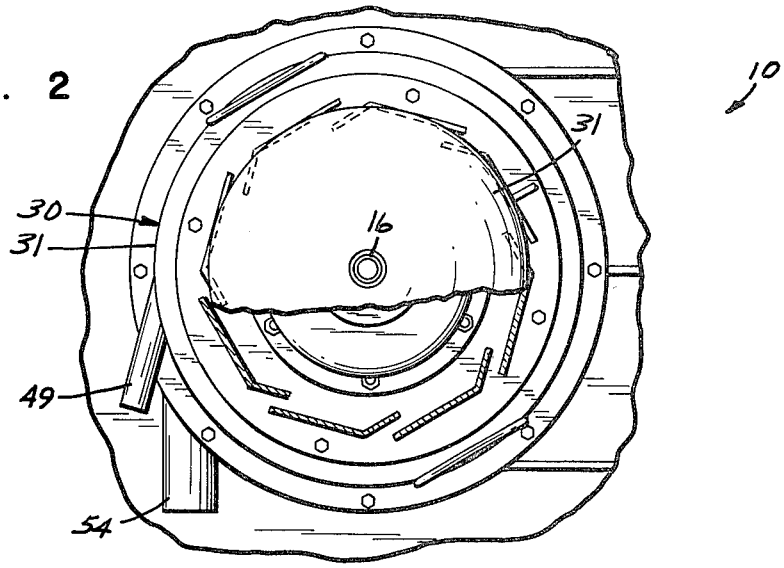
FIG. 2 is a top plan view of the present invention.

Referring again to FIG. 1 and also to FIG. 2, the drum 11 and the rotor assembly are mounted in a housing 30 having a generally cylindrical body 31, a top cover 32 and a bottom portion 33. The assembly of nested discs 22, 24, 25 is secured to the rotor shaft head 27 by a plurality of shoulder screws 20. The drum and the rotor assembly are concentrically mounted and rotate independently about a vertical axis 34. In FIG. 1, it can be seen that the drum 11 rotates on bearings 35 mounted in the housing cover 32 and bearings 36 mounted between a drum hub portion 18 and bearing sleeve 19. The rotor assembly is rotatably mounted by bearings 37 mounted between bearing sleeve 19 and rotor shaft 17. A motor (not shown) drives the rotor assembly by means of a belt 29 and a pulley 39 mounted on the rotor shaft 17. The directions of rotation for the drum 11 and rotor assembly are indicated by the arrows in FIG. 3.

Figure 4:
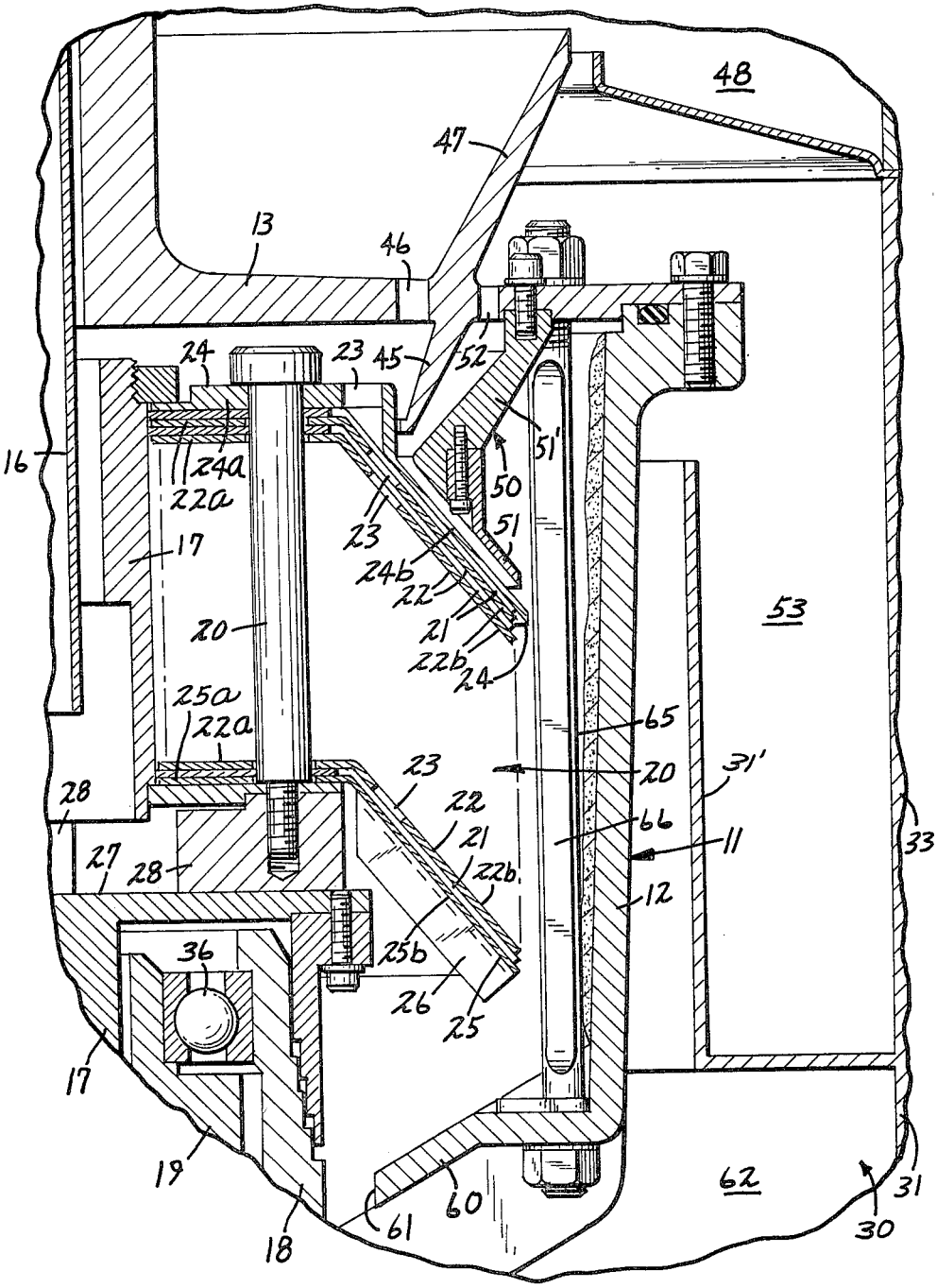
FIG. 4 is a greatly enlarged view of a portion of the present invention seen in FIG. 1.

Contaminated fluid containing liquids of differing density and generally a light liquid, e.g., a mechanically emulsified oil, a heavier liquid, e.g., a water-based coolant, and solid particles, e.g., metal chips, enters the centrifuge through the inlet manifold 16 to the bottom of the disc assembly. The contaminated fluid drops onto the rotor shaft head 27 where it is thrown or directed outwardly by the rotating set of paddles 28, into contact with the rotating fins 26 extending below the bottommost disc 25 where it is further accelerated towards the drum side wall 12. The drum 11 is then driven by the viscous or shear forces associated with the rotating fluid. In steady state operation, the rotor assembly is driven at about 3600 rpm. The rotation rate of the drum 11 lags behind that of the rotor assembly by 100–300 rpm. As the drum 11 and rotor assembly rotate a wall of fluid is built up along the side wall 12 of the drum 11. Centrifugal forces cause the solid particles in the fluid to be thrown radially outward to accumulate in the portion of the fluid wall closest to the side wall 12 of the drum 11 as shown in FIG. 4.

As the wall of fluid builds upward and flow continues to enter the centrifuge 10, the solids heavier than the fluid separate and move to the drum side wall 12. The lighter liquid separates from the heavier liquid within the disc assembly and flows upward along the surfaces of the individual discs 22, 25. As the light liquid collects towards the central portion of each disc, it eventually overflows into the apertures 23 of the discs 22, 24 and proceeds upward towards the upper portion of the disc assembly where it then overflows out of the top disc apertures 23 and is guided upward to the drum top wall member 13 by a downwardly extending annular baffle member 45, best seen in FIG. 4. As the clarified light liquid moves upward along the baffle member 45, it overflows out of the drum through light liquid discharge openings 46 provided in the top wall member 13 of the drum 11. The clarified light liquid then flows along a second baffle-like member 47 extending upward from the drum top to an upper collection chamber 48 and then removed through an outlet 48 from the centrifuge 10 in its clarified state. As can be seen in FIGS. 1 and 4, the topmost disc 24 of the rotor assembly has a greater diameter than the other discs 22, 25. The lip portion formed by the greater diameter prevents the light liquid flow from proceeding to the heavier liquid discharge openings 52 in the drum top wall 13, by trapping the light liquid flow within the disc assembly.

The heavier liquid separated from both the light liquid and the solids flows upward near the outer side edges of the disc assembly. When the flow has reached the level of the top disc 24 it flows radially inward between the top disc 24 and a parallel portion 51 of an extension means 50. See FIG. 4. The extension means 50 is a fixed structural member for preventing carryover of contaminated fluid and solids into the disc assembly and liquid discharge openings 46, 52 during the purge cycle. In the preferred embodiment it is shown as an angled, annular member mounted between the drum side wall 12 and the heavier liquid openings 52 in the drum top wall member 13. A portion 51 of the means 50 extends substantially parallel and close to a portion of the conical surface of the topmost disc 24 in the rotor assembly. It is in this gap between the parallel extension portion 51 and the conical surface of the top disc 24 that the clarified heavier liquid flows upward and inward. As it passes the parallel portion 51 of the extension means 50 it then proceeds generally upward in the space between the baffle member 45 and an extension portion 51' where it overflows the drum 11 through the circular arrangement of heavier liquid openings 52 in the drum top wall member 13. As the clarified heavier liquid passes through the openings 52, it enters a lower collection chamber 53 from which it is subsequently released from the centrifuge through an outlet 54. The upper collection chamber 48 is defined by the area between housing 30 and the drum top wall member 13. The lower collection chamber 53 is defined by the centrifuge housing body 31 and an internal wall 31' of the housing as shown in FIG. 4. Each chamber is separate from the other.

An air brake 55 shown in FIG. 1 is used to slow and stop the drum 11 when the purge cycle is initiated. When the brake 55 is actuated, a shoe 56 is driven upwards and held against a projection 57 which is in effect an extension of the drum 11.

An annular wall or baffle 60 extends from the bottom of the drum side wall 12. An opposite apex thereof defines an edge or lip opening 61 into which the fluid containing the resuspended particles flows during the purge cycle. The edge opening 61 is formed inwardly of the baffle 60 and beyond the centers of the clarified light liquid openings 46 in the drum top wall 13. Note also in FIGS. 1 and 4 that the peripheral edges of the rotor disc assembly extend beyond the outermost edges of the clarified heavier liquid openings 52. Particles, as stated above, accumulate during the separation process on the drum side wall 12 between the drum top wall member 13 and the baffle 60.

A pair of purge rods 65 are bolted to the inside of the drum 11 near the side wall 12 so as to extend from the drum top wall member 13 to the inner edge of the baffle 60. The rods 65 are positioned opposite each other in the drum 11 as illustrated in FIG. 3. Each rod 65 has a generally circular cross-section, but a longitudinal flat surfaced portion 66 along the rod length is also provided. Each rod's flat surface faces opposite the directions of rotation shown in FIGS. 3 and 4.

When the drum 11 is stopped or slowed, the rotor assembly continues to rotate. The fluid is disrupted and the accumulated particles are penetrated by fluid flow diverted as a result of impacting the flat surfaces 66 of the purge rods 65. The particles are then resuspended in the fluid. As the purge cycle continues, the fluid and the resuspended particles flow inwardly and downwardly along the upper surface of the baffle 60, downwardly through the lip openings 61 and downwardly through an opening 62' leading from solids collection chamber 62. The purged fluid and solids then exit the centrifuge through a ramp-like outlet 67, only partially shown in FIG. 1.

OPERATION OF THE PREFERRED EMBODIMENT

After the introduction of the contaminated fluid into the drum 11 at the bottom of the disc assembly, it is accelerated outward, towards the drum side wall 12 by the rotating paddles 28 and fins 26. The rotational speed of the drum 11 and heavier liquid will lag behind the speed of the rotor assembly containing the separated lighter liquid by approximately 100–300 rpm. Such a lag in speed by the drum 11 and heavier liquid would normally require a greater level of heavier liquid in the drum 11 to counteract the outward pressure of the light liquid flowing within the high speed rotor assembly in order for the light liquid to be "skimmed" from the heavier liquid. However, there being no obstructions between the independently rotating drum 11 and rotor assembly, there exists in the unobstructed area a free vortex whose forces bring about the "skimming" of the light liquid from the surface of the heawvier liquid. As the heavier liquid begins to flow inwardly in the gap between the conical surface of the top disc 24 of the rotor assembly and the parallel portion 51 of extension means 50, it approaches a smaller diameter near the exit openings 52 in the drum top wall member. As it passes into this area of smaller diameter, it speeds up and in turn creates an outward back pressure which forces the light liquid into a smaller diameter within the disc assembly, thus creating the necessary differences in levels between the heavier liquid and the light liquid in the drum for the "skimming" process. The light liquid flow within the disc assembly becomes that of a forced vortex as a result of the obstructing and confining disc spacings and the radial spacers 21. The level of light liquid within the disc assembly assumes a smaller diameter than if the flow of the heavier liquid outside the rotor assembly were a forced vortex. The light liquid is then "skimmed" off the heavier liquid as a result of the level differences caused by the vortex pressures. The "skimmed" light liquid moves upward and finally into the upper collection chamber 48. This is a "skimming procedure" previously unknown in the prior art centrifuges. An example of prior art skimming is taught in the centrifuge of U.S. Pat. No. B,422,467 to Niemeyer. In Niemeyer's centrifuge all of the centrifuge elements are rotated at one speed. Rotating together, the oil or lighter liquid will naturally build up upon the coolant or heavier liquid at which time it is then skimmed off by tube means rotating with the drum.

During the purge cycle of the present invention, the problem of contaminating the clarified liquid openings with resuspended particles was overcome by providing an extension means 50 between the drum top wall member 13 and the top disc 24 of the rotor assembly. As can be best seen in FIG. 4, the extension means 50 includes an annular, generally downwardly extending portion 51 running parallel and close to the conical surface of the top disc 24. It was found that not only did the extension means 50 prevent the carryover of resuspended solids into the clarified liquid openings 46, 52 but additionally the extension means 50 improved the separation of the liquids in the invention. The narrow gap between the extension means 50 and the top disc 24 created the restriction of heavier liquid flow into a smaller diameter, which in turn caused the back pressure on the light liquid within the disc assembly. The conclusion of such a discovery was that above a critical flow through the centrifuge 10 liquid levels within the rotor assembly and the drum 11 become highly dependent on the flow rate of the contaminated fluid entering the centrifuge 10.

The resulting operational advantages of the present invention are significant for industries using liquid/-liquid/solid centrifuges. One of those advantages is that the light liquid can be almost totally ejected from the rotor assembly prior to the purge cycle by briefly increasing the flow of contaminated fluid through the centrifuge prior to applying the air brake. The fluid subsequently discharged during the purge cycle will contain very little light liquid. Another advantage exists in situations where significant amounts of light liquid are present in the entering contaminated fluid. The light liquid can be separated out in high fluid flows without flooding the rotor assembly or being reentrained in the heavier liquid because the vortex relationships between the light and heavier flows will maintain necessary level differences for the "skimming" of the light liquid. And if only a relatively small amount of the light liquid is present, the incoming fluid can be processed at a lower flow rate and thereby yield a higher purity of clarified heavier liquid. Thus, the application of this invention to an industry requiring the processing of contaminated fluids on a recirculating basis can be greatly appreciated. The fluid can be sent through the centrifuge initially at relatively high flows removing a high portion of contaminant and light liquid, after which the recirculating fluid flow can be reduced and a higher degree of heavier liquid clarification obtained.

Overall, the present invention embodies a simpler design with fewer precision parts than that of the prior art liguid/liquid/solid centrifuges. The present invention has a higher tolerance for both particle size (up to ½ inch diameter) and quantity (100 cubic inches per hour) without using a pre-filter because of its effective purging technique. Less maintenance is anticipated for the present invention as a result of its operation at lower rotational speeds. Prior art centrifuges operating at significantly higher rotational speeds have recurring unbalancing and vibrational problems absent in the present invention. The longer residence time resulting from the use of larger disc diameters in the present invention combined with the advantages afforded through recirculating flow achieve the separation of mechanically emulsified oils at lower "g" forces without the danger of splitting the chemically emulsified soluble oil from the heavier liquid or coolant. This is an achievement not possible with the devices of the prior art.

What is claimed is:

1. A self-purging centrifuge comprising:

(a) a drum having a side wall and a top wall member, mounted for rotation about a generally vertical axis;

(b) a rotor assembly coaxially mounted in said drum for independent rotation with respect to said drum, said rotor assembly comprising a plurality of nested discs having downwardly sloping, spaced surfaces and having the outer peripheral edges thereof spaced a substantial distance from said side wall of said drum, said rotor assembly including aligned disc portions with apertures therein allowing light liquid flow therethrough;

(c) means for introducing into said drum a fluid comprising liquids of differing densities and solid particles;

(d) means for rotating said rotor assembly, said fluid rotating therewith, and said rotating fluid in turn causing rotation of said drum;

(e) said drum top wall member having portions with inner and outer radially spaced liquid discharge openings therein;

(f) an annular baffle member extending generally downward from said top wall member intermediate said inner and said outer openings, said baffle member guiding liquid overflow from said rotor assembly apertures into said inner openings of said top wall member;

(g) extension means on said drum for preventing fluid and solids carryover into said liquid discharge openings during a purge cycle;

(h) means for defining a solid particles collection area adjacent said drum side wall; and (i) means for slowing the rotation of said drum, to initiate a purge cycle, said fluid and particles draining from said drum over said baffle during the purge cycle.

2. The apparatus of claim 1, wherein said extension means includes an annular member extending generally downwardly from said top wall member and including a portion extending substantially parallel to and adjacent a conical surface portion of a top disc of said rotor assembly.

3. The apparatus of claim 1 wherein said rotor assembly includes spacer means for holding said discs in spaced apart relation whereby a light liquid can flow therein, each said disc comprising a substantially flat, circular portion and an annular, downwardly sloping portion, said sloping portion defining a frusto-conical disc surface.

4. The apparatus of claim 1 wherein said discs include a topmost disc having a lip portion extending beyond said outer peripheral edges of said other discs in said rotor assembly.

5. The apparatus of claim 1 wherein a plurality of downwardly extending fins are secured to a bottommost disc and are spaced apart, said fins enhancing the outward acceleration of said fluid toward said drum side wall.

6. The apparatus of claim 1, including a rotor shaft head positioned beneath a truncated portion of a bottommost disc and mounted for axial rotation with said rotor assembly, said rotor shaft head having a plurality of fixed paddle members, said paddle members extending generally upward towards said nested disc assembly and radially outward towards said drum side wall.

7. The apparatus of claim 1 further including a purge rod mounted to said drum and extending proximate said drum side wall, said purge rod having a flat surface portion diverting said contaminated fluid flow into the collected particles on said drum side wall during the purge cycle.

8. A self-purging centrifuge comprising:

(a) a drum having a side wall and a top wall member, mounted for rotation about a generally vertical axis;

(b) a rotor assembly coaxially mounted in said drum for independent rotation with respect to said drum, said rotor assembly comprising a multiplicity of nested, truncated cone discs having spaced surfaces and having the outer peripheral edges thereof spaced a substantial distance from said side wall of said drum, said discs including a bottommost disc having no apertures therein and a plurality of other discs having portions with aligned apertures therein allowing light liquid flow therethrough;

(c) means for introducing into said drum under said bottommost disc of said rotor assembly a fluid comprising a light liquid, a heavier liquid and solid particles, each to be separated therefrom;

(d) means for driving said rotor assembly at a predetermined rotational speed to propel said fluid outwardly toward said drum side wall, said fluid rotating therewith and in turn causing rotation of said drum;

(e) said drum top wall member having an inner circle and an outer circle of radially spaced openings, said inner openings allowing clarified light liquid flow therethrough and said outer openings allowing clarified heavier liquid flow therethrough;

(f) an annular baffle member disposed intermediate said inner and outer openings and extending generally downwardly from said top wall member, said baffle member positioned to guide overflow of said light liquid from said disc apertures toward said inner circle of top wall member openings;

(g) means including extension means mounted to said drum proximate said outer openings for preventing fluid and solids carryover into said openings during a purge cycle;

(h) an annular baffle extending inwardly from the bottom of said drum side wall, to define with said top wall member, said side wall and said outer edges of said rotor disc assembly, a solid particles collection area therebetween, said baffle having an inner edge spaced from said side wall a greater distance than the outermost edges of said openings in said top wall member; and (i) means for abruptly slowing the rotation of said drum, to initiate a purge cycle by disrupting the rotating fluid and thereby resuspending the separated particles in the fluid, said fluid and resuspended particles draining from said drum over said baffle during the purge cycle.

9. The apparatus of claim 8, wherein said extension means includes an annular member extending generally downwardly from said top wall member and including a portion extending substantially parallel to and adjacent a conical surface of a top disc of said rotor assembly.

10. The apparatus of claim 8 wherein said top disc has a greater diameter than said other discs within said rotor assembly.

11. The apparatus of claim 8 including a housing having an upper collection chamber and a lower collection chamber, said upper collection chamber being positioned above said drum top wall member, means for guiding clarified light liquid flow from said top wall member inner openings into said upper chamber, said lower collection chamber being located within said housing adjacent said drum side wall, said lower chamber receiving clarified heavier liquid flow from said top wall member outer openings.

12. The apparatus of claim 11 wherein said chambers are each connected to respective outlet means for removing clarified liquids from said apparatus.

13. The apparatus of claim 8 wherein said rotor assembly includes spacer means for holding said discs in spaced apart relation whereby a light liquid can flow therein, each said disc comprising a substantially flat, circular portion and an annular, downwardly sloping portion, said sloping portion defining a conical disc surface.

14. The apparatus of claim 8 wherein a plurality of downwardly extending fins are secured to a bottom surface of said bottommost disc to enhance the outward acceleration of said fluid, said fins being spaced apart at substantially equal intervals along said disc.

15. The apparatus of claim 8, including a rotor shaft head positioned beneath said bottommost disc and mounted for axial rotation with said rotor assembly, said rotor shaft head having a purality of fixed paddle members, said paddle members extending generally upward towards said bottom surface of said bottommost disc and radially outward towards said drum side wall.

16. The apparatus of claim 8 further including a purge rod mounted to said drum and extending between said top wall member and said annular baffle proximate said drum side wall, said purge rod causing a disruption of fluid flow during the purge cycle.

17. The apparatus of claim 16 wherein said purge rod is generally circular in cross-secction having a longitudinal portion thereof flat-surfaced, said flat-surfaced portion facing opposite the direction of rotation of said rotor assembly and said drum.

18. A self-purging centrifuge comprising:

(a) a drum having a side wall and a top wall member, mounted for rotation about a generally vertical axis within a housing;

(b) a rotor assembly coaxially mounted in said drum for independent rotation with respect to said drum, said rotor assembly comprising a multiplicity of nested, truncated cone discs, each said disc comprising a substantially flat, circular portion and an annular downwardly sloping portion, with surfaces spaced apart by radial spacer means, said discs having outer peripheral edges spaced a substantial distance from said drum side wall, said assembly including a topmost disc and a bottommost disc, said topmost disc having a greater diameter than said remaining discs, said bottommost disc having no apertures therein with said remaining discs each having aligned portions with apertures therein allowing light liquid flow therethrough;

(c) means for introducing a contaminated fluid into said drum beneath said bottommost disc, said fluid comprising a light liquid, a heavier liquid and solid particles, each to be separated therefrom;

(d) means for driving said rotor assembly at a predetermined speed to propel said fluid outwardly toward said drum side wall, said fluid rotating therewith, and said rotating fluid in turn causing rotation of said drum;

(e) means for enhancing the acceleration of said fluid being propelled toward said drum side wall, said means including downwardly extending fins secured to an underside of said bottommost disc;

(f) radially spaced portions in said drum top wall member having openings therein for allowing clarified liquid flow therethrough, said openings including inner openings and outer openings arranged in concentric circles in said top wall member, said inner openings allowing clarified light liquid flow therethrough and said outer openings allowing clarified heavier liquid flow therethrough;

(g) an annular baffle member disposed intermediate said inner and said outer openings and extending generally downward from said top wall member near a top surface of said rotor assembly, said baffle member guiding overflow of clarified light liquid from said top disc apertures upwards into said inner openings in said top wall member;

(h) an upper collection chamber and a lower collection chamber disposed within said housing, said upper collection chamber positioned above said drum top wall member, means extending upward from said top wall member for guiding clarified light liquid flow from said inner openings into said upper chamber, said lower collection chamber located within said housing adjacent said drum side wall, said lower chamber receiving clarified heavier liquid overflow from said outer openings in said drum top wall member;

(i) means including extension means mounted to said drum top wall member intermediate said outer openings and said drum side wall for preventing contaminated fluid carryover into said openings during a purge cycle, said extension means including an annular member extending generally downwardly from said drum top wall member and a portion extending substantially parallel to and adjacent a conical surface of said top disc of said rotor assembly;

(j) an annular baffle extending inwardly from the bottom of said drum side wall, to define with said drum top wall member, said drum side wall, and said outer peripheral edges of said discs a solid particles collection area therebetween, said baffle having an inner edge spaced from said drum side wall a greater distance than the outer edges of said inner openings in said top wall member; and (k) means for abruptly slowing the rotation of said drum to initiate a purge cycle by disrupting the rotating fluid and thereby resuspending the separated solid particles in the fluid, said fluid and resuspended particles draining from said drum over said baffle during the purge cycle.

19. The apparatus of claim 18, said apparatus including a rotor shaft head positioned beneath a truncated portion of said bottommost disc and mounted for axial rotation with said rotor assembly, said rotor shaft head having a plurality of fixed paddle-members extending generally upward towards said bottommost disc and radially outward towards said drum side wall.

20. The apparatus of claim 18 including a pair of oppositely disposed purge rods, each purge rod mounted to said drum between said top wall member and said annular baffle proximate said drum side wall, said rods causing a disruption of the contaminated fluid flow during the purge cycle.

21. The apparatus of claim 20 wherein each said purge rod has a flat-surfaced portion facing opposite the direction of rotation of said rotor assembly and said drum.

22. The apparatus of claim 18 wherein each said clarified liquid collection chamber is connected to outlet means for releasing clarified liquid from said apparatus.

* * * * *